US007017984B2

(12) United States Patent
Chen

(10) Patent No.: US 7,017,984 B2
(45) Date of Patent: Mar. 28, 2006

(54) FOLDING RECLINING CHAIR WITH ARMS

(76) Inventor: Libin Chen, Qiaoyu Building, Boyi Town, Ximenwai, Changzhou, Jiangsu 213147 (CN)

( * ) Notice: Subject to any disclaimer, the term of this patent is extended or adjusted under 35 U.S.C. 154(b) by 0 days.

(21) Appl. No.: 10/783,461

(22) Filed: Feb. 20, 2004

(65) Prior Publication Data

US 2005/0022303 A1 Feb. 3, 2005

(30) Foreign Application Priority Data

Jul. 31, 2003 (CN) ..... 03259964 U

(51) Int. Cl.
*A47C 4/00* (2006.01)

(52) U.S. Cl. ..... 297/45; 297/44

(58) Field of Classification Search ..... 5/110, 5/111, 187; 297/45, 44, 42

See application file for complete search history.

(56) References Cited

U.S. PATENT DOCUMENTS 244,216 A * 7/1881 Fenby ..... 248/164
6,364,410 B1 * 4/2002 Tang ..... 297/16.2

* cited by examiner

*Primary Examiner*—Sunil Singh
(74) *Attorney, Agent, or Firm*—Martine Penilla & Gencarella, LLP

(57) ABSTRACT

A folding reclining chair with arms that is convenient to carry and is comfortable and safe for use in households, outdoors, in courtyards, in parks, and at beaches. The folding reclining chair has a left-right symmetrical structure that includes a reclining chair body support, arms, and a reclining chair plane. The reclining chair body support includes a front support and a rear support. The front support includes a foot-rest rod, a front leg tube, a front support rod, a rear support rod, a connection rod, and front crossed rods. The rear support includes a seating frame rod, a back-rest tube, middle crossed rods, and a rear crossed rod. The reclining chair body support structure has high strength because the reclining chair body foot-rest rod, the front support rod, rear support rod, and connection rod form a quadrangular structure, and the rear support uses a crossed support and has folding arms.

10 Claims, 6 Drawing Sheets

FOLDING RECLINING CHAIR WITH ARMS

FIELD OF THE INVENTION

This invention relates to a folding reclining chair with arms that is suitable for travel and leisure and that can be used in a variety of environments including, for example, in households, outdoors, in a courtyard, in a park, and at the beach.

BACKGROUND OF THE INVENTION

The existing folding bed suitable for travel and leisure mainly has two structures. One uses an assembly-type structure composed of a plurality of U-shaped rectangular frames, with the fabric being able to be stretched tight. This is comfortable for sitting and lying, but has a large volume when folded, and is thus inconvenient for carrying and depositing. The other uses a plurality of crossed supports connected together, and has a small volume when folded, but the fabric is unable to be stretched tight because the fabric is connected to the bed support via some fixing points. When a person sits, lies, or sleeps on the bed, the bed will sink undesirably and for this reason is uncomfortable in use. In addition, the bed body support structure has poor strength and therefore can bear only a relatively small load. Thus, after a period of use or upon bearing a heavy load, the bed plane is likely to tear.

SUMMARY OF THE INVENTION

The present invention provides a folding reclining chair with arms that overcomes the above-mentioned defects of conventional folding reclining chairs. The front support of the reclining chair body support is configured to form a quadrangular structure. The rear support employs crossed supports and has folding arms, which enforces the strength of the reclining chair body support structure. The reclining chair plane is fitted onto the reclining chair body support, and thus can easily be stretched tight. A person feels comfortable when sitting, lying, or sleeping on the reclining chair surface, with both hands resting on the arms, thus achieving an object of comfort and convenience.

In one embodiment, the folding reclining chair with arms includes a reclining chair body support, arms, and a reclining chair plane. The reclining chair body support includes a front support and a rear support. The front support includes a foot-rest rod, a front leg tube, a front support rod, a rear support rod, a connection rod, and a pair of front crossed rods. The rear support includes a seating frame rod, a back-rest rod, a middle crossed rod, and a rear crossed rod.

The front end of the foot-rest rod is connected to the front support rod via a fixing element. One end of the rear support rod is connected to the middle portion of the foot-rest rod via a fixing connection element, and the other end of the rear support rod is connected to the lower portion of the back-rest rod. One end of the connection rod is connected to the rear support rod, and the other end of the connection rod is connected to the front support rod via a sliding sleeve. The front leg tube is connected to the rear support rod through the sliding sleeve. The foot-rest rod, front support rod, rear support, and connection rod form a quadrangular structure so that the position of the front leg tube can be adjusted conveniently by means of the sliding sleeve along with the folding and unfolding of the integral reclining chair frame. One end of the front crossed rod is connected to the rear support rod via a U-shaped hinging element and the other end is connected to the sliding sleeve. The rear end of the foot-rest rod is connected to the seating frame rod via a rotary connection element, and the seating frame rod is hinged to the back-rest rod. One end of the middle crossed rod is connected to the seating frame rod, and the other end of the middle crossed rod is connected to the lower portion of the back-rest rod. One end of the rear crossed rod is connected to the upper portion of the back-rest rod via a U-shaped hinging element, and the other end thereof is connected to the lower portion of the seating frame rod.

The arms may be rigid or soft. When rigid arms are used, the arm support rod is connected to the upper portion of the seating frame rod by means of an arm support rod fixing element. One end of the rigid arm is connected to the back-rest rod, and the other end to the arm is connected to the support rod. When soft arms are used, the arms are disposed at the upper portion of the middle crossed rod, and the middle crossed rod is connected to the seating frame rod via a U-shaped hinging element.

The folding reclining chair plane is fitted onto the foot-rest rod, the seating frame rod, and back-rest rod of the reclining chair body support.

The operation principles of the folding reclining chair with arms will now be described. To use the folding reclining chair, the seating frame rod and the back-rest rod are pushed apart. At this time, the rear support rod automatically unfolds the front support rod and foot-rest rod, and the front leg tube slides along with the sliding sleeve mounted on the front support rod and the connection rod. The reclining chair body and reclining chair plane are then unfolded at once. When the sliding sleeve slides upward to the limiting position portion, the reclining chair frame is fully unfolded for use. To fold the folding reclining chair, the seating frame rod and back-rest rod are folded inward. At the same time, the rear support rod and foot-rest rod are pulled inward to cause the quadrangular structure to fold, and the sliding sleeve moves downward to the lower portion of the front leg tube to cause the reclining chair plane and the entire support to fold into a package for carrying.

The folding reclining chair with arms is elegantly designed and has a compact structure. The entire reclining chair can be freely folded and unfolded because the reclining chair body foot-rest rod, the front support rod, rear support, and the connection rod form a quadrangular structure, and the rear support uses a crossed support and has folding arms. In addition, the reclining chair becomes small when folded. When the reclining chair is unfolded, because the seating frame rods and the back-rest rods are connected from front to rear to form two side frames of the folding reclining chair and the reclining chair plane fabric is fitted onto these rods at both sides, the reclining chair plane fabric gradually stretches tight along with the unfolding of the supports and has a uniform force. A person feels comfortable when lying on the reclining chair. The reclining chair body support structure has a high strength and a large bearing load. The folding reclining chair with arms can be used as a deck reclining chair, sleeping reclining chair, and sitting reclining chair as well. The reclining chair is safe and reliable when a person sits on different positions of the reclining chair body support. As the reclining chair is provided with rigid or soft arms, a person sitting or resting on the reclining chair may lean on the arms. And the folding reclining chair is comfortable in use and convenient to fold and carry.

DETAILED DESCRIPTION OF THE INVENTION

Figure 1:
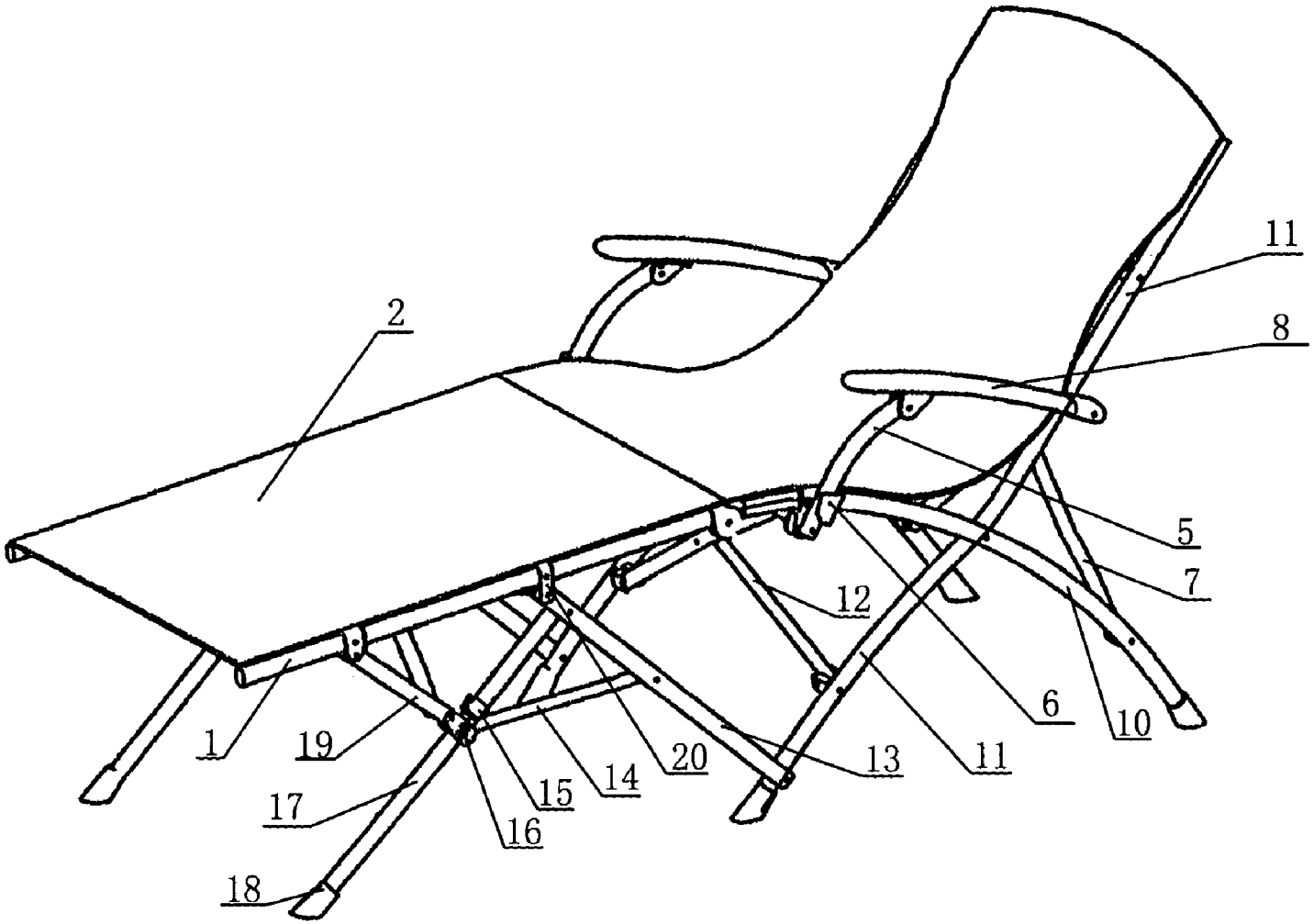
FIG. 1 is a schematic diagram of the first example of the folding reclining chair with arms according to this invention.

In the following discussion, the present invention is further described in conjunction with the drawings.

Referring to FIGS. 1 through 6, the folding reclining chair with arms of this invention includes a reclining chair body support, arms 8, and a reclining chair plane or fabric 2. The reclining chair body support includes a front support and a rear support. The front support includes foot-rest rods 1 disposed oppositely from one another at left and right sides of the front support, front leg tubes 17, a front support rod 19, a rear support rod 13, a connection rod 14, and a pair of front crossed rods 3. The rear support includes seating frame rods 10 disposed oppositely from one another at left and right sides of the rear support, a back-rest rod 11, a pair of middle crossed rods 12, and a pair of rear crossed rods 7.

As the folding reclining chair with arms of this invention is a left-right symmetrical structure, the following exemplary description is based on one side of the structure, with it being understood that the structure of the other side is the same. The front end of the foot-rest rod 1 is connected to the front support rod 19 via a fixing connection element 20. One end of the rear support rod 13 is connected to the middle portion of the foot-rest rod 1 via a fixing connection element 20. The other end of the rear support rod 13 is connected to the lower end of the back-rest rod 11. One end of the connection rod 14 is connected to the rear support rod 13, and the other end of the connection rod 14 is connected to the front support rod 19 via a sliding sleeve 16. The sliding sleeve 16 is disposed on the front leg tube 17, and the front leg tube 17 is connected to the rear support rod 13. The foot-rest rod 1, front support rod 19, rear support rod 13, and connection rod 14 form a quadrangular structure so that the position of the front leg tube can be adjusted conveniently by means of the sliding sleeve 16 along with the folding and unfolding of the integral reclining chair frame. The upper portion of the front leg tube 17 is disposed with a position limiting element 15, and the position limiting element 15 is located at the upper portion of the sliding sleeve 16 for limiting the maximum rising position of the sliding sleeve. One end of the front crossed rod 3 is connected to the rear support rod 13 and the other end is connected to the sliding sleeve 16 via a U-shaped hinging element. The rear end of the foot-rest rod 1 is connected to the seating frame rod 10 via a rotary connection element 4, and the seating frame rod 10 is hinged to the back-rest rod 11. One end of the middle crossed rod 12 is connected to the seating frame rod 10, and the other end thereof is connected to the lower portion of the back-rest rod 11. One end of the rear crossed rod 7 is connected to the upper portion of the back-rest rod 11 via a U-shaped hinging element, and the other end thereof is connected to the lower portion of the seating frame rod 10.

Figure 3:
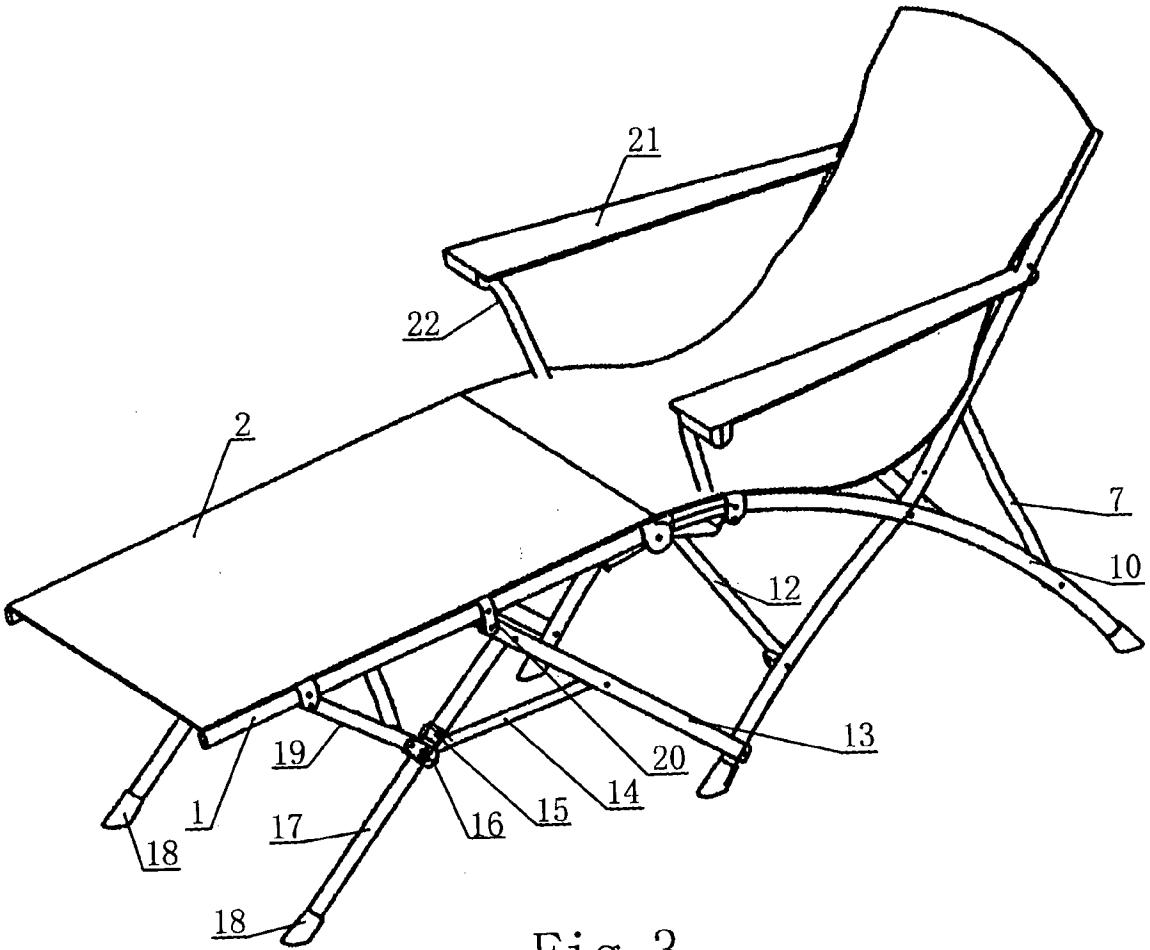
FIG. 3 is a schematic diagram of the second example of the folding reclining chair with arms according to this invention.
Figure 4:
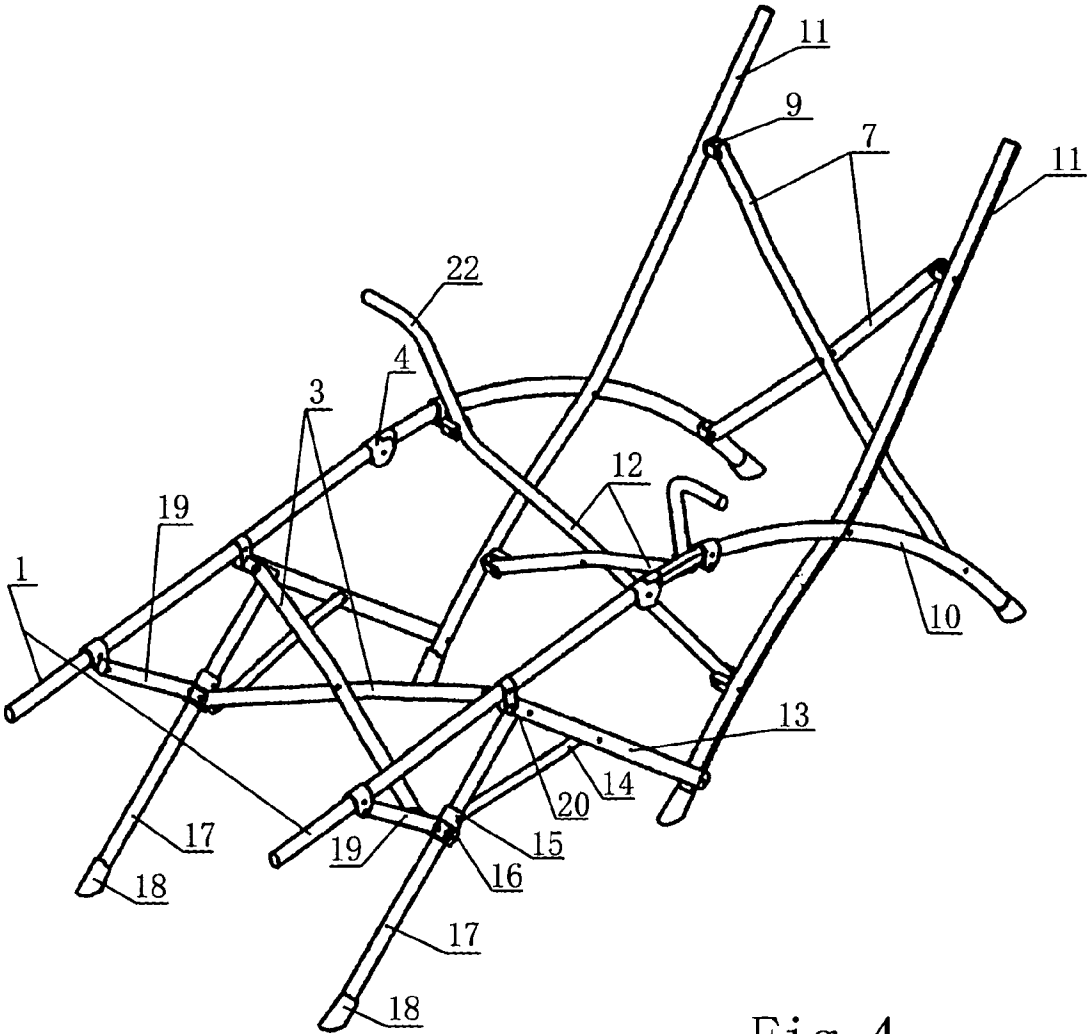
FIG. 4 is a schematic diagram of the reclining chair frame structure of the second example of the folding reclining chair with arms according to this invention.

The arms may be rigid arms 8 (see, for example, FIG. 1) or soft arms 21 (see, for example, FIG. 3). When rigid arms 8 are used, the arm support rod 5 is connected to the upper portion of the seating frame rod 10 by means of an arm support rod fixing element 6. One end of the rigid arm 8 is connected to the back-rest rod 11, and the other end thereof is connected to the arm support rod 5. When soft arms 21 are used (see FIGS. 3 and 4), the upper portion of the middle crossed rod 12 is provided with soft arm connection element 22, and the middle crossed rod 12 is connected to the arm support rod fixing element 6 fixed onto the seating frame rod 10 via a U-shaped hinging element. The soft arm connection element 22 extends upward from the upper portion of the middle crossed rod 12 and has a bent connection end. One end of the soft arm 21 is connected to the back-rest rod, and the other end is fixed to the connection end of the soft arm connection element 22. The folding reclining chair plane is fitted onto the foot-rest rod, seating frame rod, and back-rest rod of the reclining chair body support. Shoes 18 are provided at the bottoms of the front leg tube, back-rest rod, and seating frame rod.

Figure 5:
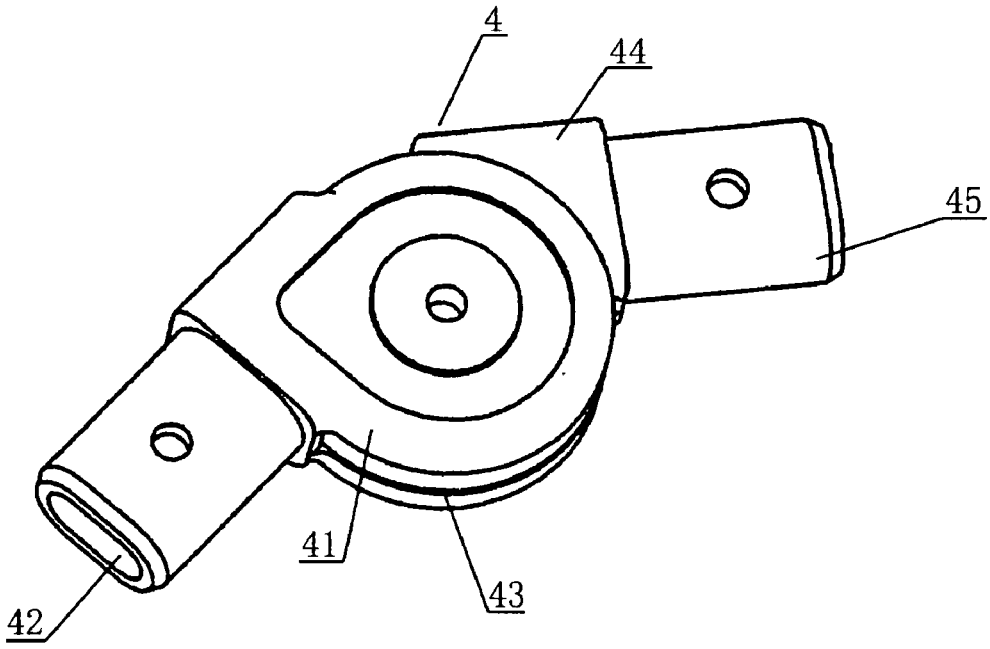
FIG. 5 is a schematic diagram of the rotary connection element of the folding reclining chair with arms according to this invention.
Figure 7:
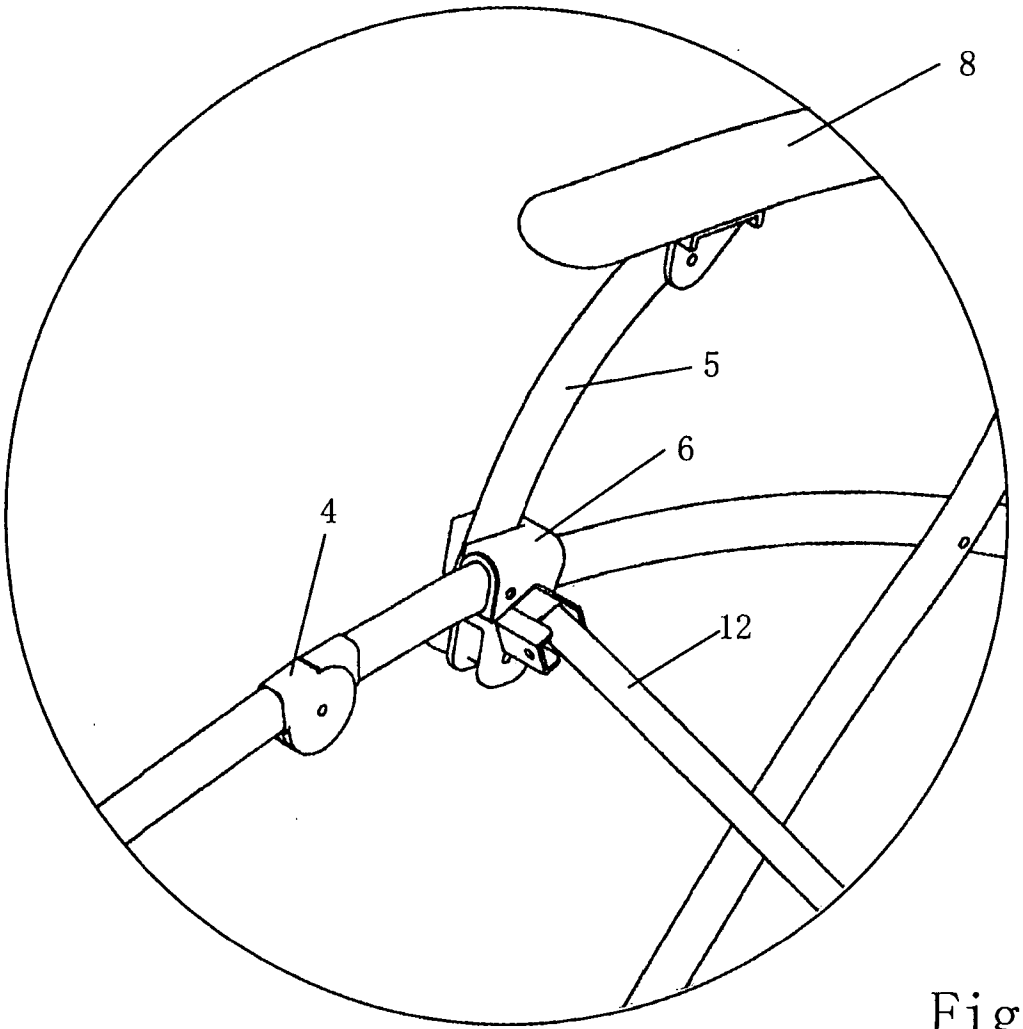
FIG. 7 is a local amplified schematic diagram of the position I shown in FIG. 2.

Referring to FIG. 5, the rotary connection element 4 of the folding reclining chair with arms has an open rotary element 41 and a socket rotary element 44. One end of the socket rotary element 44 is inserted into the notch 43 of the open rotary element 41 to accomplish a mutually rotary connection, and the other end of the socket rotary element 44 is provided with the connection end 45, which is connected to the seating frame rod 10. The open rotary element 41 is provided with a foot-rest rod connection end 42, which is connected to foot-rest rod 1.

Figure 2:
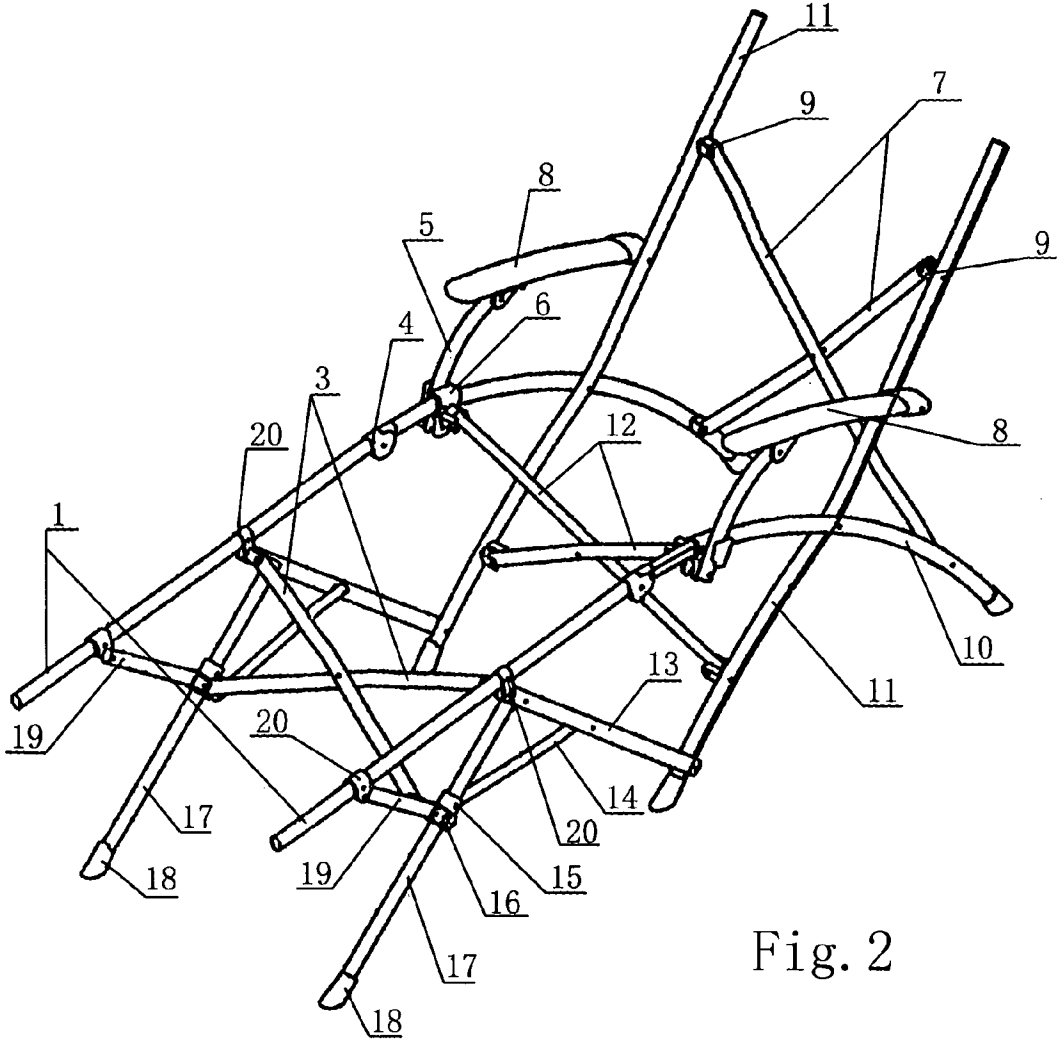
FIG. 2 is a schematic diagram of the reclining chair frame structure of the first example of the folding reclining chair with arms according to this invention.
Figure 6:
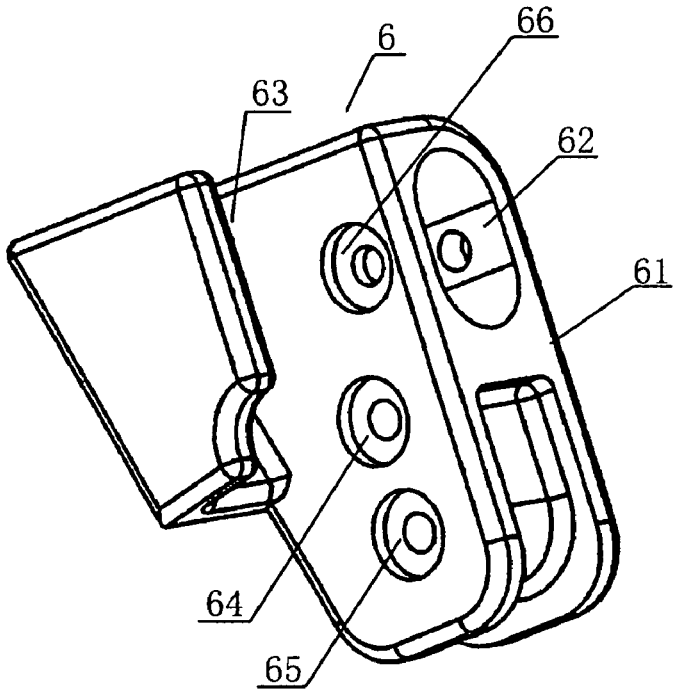
FIG. 6 is a schematic diagram of the arm support rod fixing connection element of the folding reclining chair with arms according to this invention.

Referring to FIGS. 1, 2, and 6, the arm support rod fixing element 6 of the folding reclining chair with arms has a fixing element body 61, which is provided with a seating frame rod connection hole 62. A through hole 66 passes through the seating frame rod connection hole 62 from one side of the fixing element body to the other side thereof, and the seating frame rod 10 passes through the seating frame connection hole 62. The seating frame rod 10 is connected to the fixing element 6 by means of an axle passing through the through hole 66. The fixing element body 61 is provided with an arm support rod connection hole 65 in the same axle direction as the through hole 66 and U-shaped hinging hole 64. The arm support rod connection hole 65 and U-shaped hinging hole 64 are located at the lower/upper side of the seating frame rod connection hole, and at the lower side in this example. An arm support rod fixing groove 63 is disposed at one side of the fixing element body 61, and the arm support rod 5 can be fitted into it.

To use the folding reclining chair, the seating frame rod 10 and the back-rest rod 11 are pushed apart. At this time, the rear support rod 13 automatically unfolds the front support rod 19 and foot-rest rod 1, and the front leg tube 17 slides along with the sliding sleeve 16 mounted on the front support rod 19 and the connection rod 14. The reclining chair body and reclining chair plane 2 are then unfolded at once for use. To fold the folding reclining chair, the seating frame rod 10 and back-rest rod 11 are folded inward. At the same time, the rear support rod 13 and foot-rest rod 1 are pulled inward to cause the quadrangular structure to fold, and the sliding sleeve 16 moves downward to the lower portion of the front leg tube 17 to cause the reclining chair plane 2 and the entire support to fold into a package for carrying.

The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims and equivalents thereof.

The invention claimed is:

1. A folding reclining chair with arms, comprising: a reclining chair body support, arms, and a reclining chair plane, wherein said reclining chair body support comprises a front support and a rear support, said front support includes a foot-rest rod, a front leg tube, a front support rod, a rear support rod, a connection rod, and a pair of front crossed rods, said rear support includes a seating frame rod, a back-rest rod, a pair of middle crossed rods, and a rear crossed rod, a front end of said foot-rest rod is connected to said front support rod, one end of said rear support rod is connected to a middle portion of said foot-rest rod via a fixing connection element, the other end of said rear support rod is connected to a lower portion of said back-rest rod, one end of said connection rod is connected to said rear support rod, the other end of said connection rod is connected to said front support rod via a sliding sleeve, one end of said front crossed rod is connected to said rear support rod via a U-shaped hinging element and the other end of said front crossed rod is connected to said sliding sleeve, a rear end of said foot-rest rod is connected to said seating frame rod via a rotary connection element, said seating frame rod is hinged to said back-rest rod, one end of each of said middle crossed rods is connected to an arm support rod fixing element secured to the seating frame rod via a U-shaped hinging element, the other end of each of said middle crossed rods is connected to the lower portion of said back-rest rod, one end of said rear crossed rod is connected to an upper portion of said back-rest rod via a U-shaped connection element, and the other end of said rear crossed rod is connected to a lower portion of said seating frame rod via a U-shaped connection element.

2. The folding reclining chair with arms according to claim 1, wherein said foot-rest rod, said front support rod, said rear support, and said connection rod form a quadrangular structure.

3. The folding reclining chair with arms according to claim 1, wherein said arms are rigid arms or soft arms.

4. The folding reclining chair with arms according to claim 3, wherein when the arms are rigid arms, an arm support rod is connected to an upper portion of said seating frame rod by means of said arm support rod fixing element, one end of each of said rigid arms is connected to the back-rest rod, and the other end of each of said rigid arms is connected to the arm support rod.

5. The folding reclining chair with arms according to claim 3, wherein when the arms are soft arms, a soft arm connection element is disposed at an upper portion of each of said middle crossed rods.

6. The folding reclining chair with arms according to claim 5, wherein each of said soft arm connection elements extends upward from the upper portion of one of said middle crossed rods and has a bent connection end.

7. The folding reclining chair with arms according to claim 6, wherein one end of each of said soft arms is connected to said back-rest rod, and the other end of each of said soft arms is fixed to the bent connection end of one of said soft arm connection elements.

8. The folding reclining chair with arms according to claim 1, wherein said reclining chair plane is fitted onto said reclining chair body support, said foot-rest rod, said seating frame rod, and said back-rest rod.

9. The folding reclining chair with arms according to claim 1, wherein said rotary connection element has an open rotary element and a socket rotary element, with one end of said socket rotary element being inserted into a notch of said open rotary element to accomplish a mutually rotary connection and the other end of said socket rotary element being provided with a connection end connected to said seating frame rod, and said open rotary element is provided with a foot-rest rod connection end which is connected to said foot-rest rod.

10. The folding reclining chair with arms according to claim 1, wherein said arm support rod fixing element has a fixing element body provided with a seating frame rod connection hole, at least one arm support rod connection hole, and a U-shaped hinging hole, said U-shaped hinging hole and said at least one arm support rod connection hole being disposed on the fixing element body at right angles and being located at either a lower side or an upper side of said seating frame rod connection hole, and an arm support rod fixing groove is disposed at one side of said fixing element body.

* * * * *